US009551219B2

(12) United States Patent
Howes et al.

(10) Patent No.: US 9,551,219 B2
(45) Date of Patent: Jan. 24, 2017

(54) VALVES

(75) Inventors: Jonathan Sebastian Howes, Hampshire (GB); James Macnaghten, Hampshire (GB)

(73) Assignee: Energy Technologies Institute LLP, Loughborough (GB)

( * ) Notice: Subject to any disclaimer, the term of this patent is extended or adjusted under 35 U.S.C. 154(b) by 864 days.

(21) Appl. No.: 13/812,783

(22) PCT Filed: Jul. 27, 2011

(86) PCT No.: PCT/GB2011/051435
§ 371 (c)(1),
(2), (4) Date: Jan. 28, 2013

(87) PCT Pub. No.: WO2012/013978
PCT Pub. Date: Feb. 2, 2012

(65) Prior Publication Data

US 2013/0118344 A1 May 16, 2013

(30) Foreign Application Priority Data

Jul. 29, 2010 (GB) ..... 1012743.9

(51) Int. Cl.
*F01B 1/01* (2006.01)
*F01B 17/02* (2006.01)
(Continued)

(52) U.S. Cl.
CPC ..... *F01B 1/01* (2013.01); *F01B 17/02* (2013.01); *F01B 29/04* (2013.01); *F01K 7/00* (2013.01); *F01K 13/02* (2013.01); *F04B 49/22* (2013.01)

(58) Field of Classification Search
CPC ..... Y02E 70/30; Y02E 60/15; F01B 1/01; F01B 29/04; F01B 17/02; F01K 13/02; F01K 7/00; F04B 49/22
(Continued)

(56) References Cited

U.S. PATENT DOCUMENTS 3,708,979 A 1/1973 Bush et al.
3,744,934 A 7/1973 Ueno
(Continued)

FOREIGN PATENT DOCUMENTS

DE 10 2004 032215 1/2006
DE 20 2006 015204 3/2007
(Continued)

OTHER PUBLICATIONS

Examination Report in related Chinese Patent Application No. 201180037733.7, dated Jun. 30, 2014, with English-language summary.
(Continued)

*Primary Examiner* — Logan Kraft
(74) *Attorney, Agent, or Firm* — Lempia Summerfield Katz LLC

(57) ABSTRACT

An apparatus (10) for compressing and expanding a gas includes a chamber (22), a positive displacement device (24) moveable relative thereto, first and second valves (26, 28) activatable to control flow of gas into and out of the chamber (22), and a controller (80) for controlling activation of the valves (26, 28) that selectively switches operation between a compression and an expansion mode with selective switching between modes being achieved by selectively changing the activation timing of at least one of the valves during the first mode. An energy storage system including the device may be operatively coupled via a rotary device for power transmission to an input/output device, whereby the direc-
(Continued)

tion and speed of rotation are preserved during switching, and the input/output device may be synchronized to the grid.

8 Claims, 5 Drawing Sheets

(51) Int. Cl.
*F01B 29/04* (2006.01)
*F01K 7/00* (2006.01)
*F01K 13/02* (2006.01)
*F04B 49/22* (2006.01)

(58) Field of Classification Search
USPC ..... 60/398
See application file for complete search history.

(56) References Cited

U.S. PATENT DOCUMENTS

| | | | | |
|---|---|---|---|---|
| 4,224,798 | A | 9/1980 | Brinkerhoff | |
| 5,195,881 | A | 3/1993 | George, Jr. | |
| 5,832,885 | A | 11/1998 | Moyer | |
| 6,305,171 | B1 | 10/2001 | Negre et al. | |
| 6,363,723 | B1 | 4/2002 | Negre et al. | |
| 6,443,717 | B1 * | 9/2002 | Barber | F04B 7/0007 417/510 |
| 7,121,190 | B2 | 10/2006 | Ogawa et al. | |
| 7,137,788 | B2 * | 11/2006 | Goodell | F04B 39/16 417/306 |
| 7,399,167 | B2 | 7/2008 | Iwanami et al. | |
| 7,832,207 | B2 * | 11/2010 | McBride | F15B 1/024 60/410 |
| 8,065,874 | B2 | 11/2011 | Fong et al. | |
| 8,534,058 | B2 * | 9/2013 | Brun | F04B 35/045 60/408 |
| 8,656,712 | B2 * | 2/2014 | Howes | F01K 3/12 60/515 |
| 2004/0083751 | A1 | 5/2004 | Nakatani et al. | |
| 2009/0120086 | A1 | 5/2009 | Kuttler et al. | |
| 2011/0061379 | A1 | 3/2011 | Misselhorn | |

FOREIGN PATENT DOCUMENTS

| | | | |
|---|---|---|---|
| DE | 10 2008 023793 | | 12/2009 |
| GB | 2457917 | | 9/2009 |
| JP | 2006-316626 | A | 11/2006 |
| WO | 2004025122 | A1 | 3/2004 |
| WO | 2005095800 | A1 | 10/2005 |
| WO | WO 2008/064418 | | 6/2008 |
| WO | WO 2009/044139 | | 4/2009 |
| WO | 2009056140 | A1 | 5/2009 |
| WO | WO 2009/074800 | | 6/2009 |
| WO | WO 2009/074803 | | 6/2009 |
| WO | WO 2009/112145 | | 9/2009 |
| WO | WO 2011/056855 | | 5/2011 |

OTHER PUBLICATIONS

International Search Report and Written Opinion from PCT/GB2011/051435 dated Oct. 18, 2012.

* cited by examiner

VALVES

RELATED APPLICATION DATA

This U.S. national phase application is based on international application no. PCT/GB2011/051435, filed on Jul. 27, 2011, which claimed priority to British national patent application no. 1012743.9, filed on Jul. 29, 2010. Priority benefit of these earlier filed applications is hereby claimed.

BACKGROUND

1. Field of the Disclosure

The present invention relates to apparatus for compressing and expanding a gas, a method of operating the same, and particularly but not exclusively to energy storage apparatus including such apparatus for compressing and expanding a gas.

2. Description of the Related Art

Many energy storage processes involve operating gas compressors and/or expanders as part of the technology. For example, conventional energy storage techniques such as CAES (Compressed Air Energy Storage) and its variants use compressors and expanders to process gas, as does the novel energy storage technique disclosed in the applicant's own earlier application WO 2009/044139.

Certain rotary machinery has been designed to operate with gas flows in both directions, although the efficiency in each direction is normally quite low. However, most rotary machinery is normally configured to operate with gas flows passing in one direction only and hence it is necessary to have separate machinery for charge and discharge cycles.

SUMMARY

The present applicant has identified the need for improved apparatus for compressing and expanding a gas.

In accordance with the present invention, there is provided apparatus for compressing and expanding a gas, comprising: a chamber for receiving a gas; a positive displacement device moveable relative to the chamber; first and second valves activatable to control flow of gas into and out of the chamber; and a controller for controlling activation timing of first and second valves; wherein the controller is configured to selectively switch operation of the positive displacement device between a compression mode in which gas received in the chamber is compressed by the positive displacement device and an expansion mode in which gas received in the chamber is expanded by the positive displacement device, with selective switching from a first of the two modes to a second of the two modes being achieved by selectively changing the activation timing of at least one of the first and second valves during operation in the first mode.

In this way, apparatus is provided in which a positive displacement device (usually a linear positive displacement device e.g. a reciprocating piston) can seamlessly change operation between a compression mode and an expansion mode.

In one embodiment, the positive displacement device is coupled to a rotary device (e.g. rotary shaft) for transmitting mechanical power between the positive displacement device and an input/output device (e.g. a motor/generator of an electricity generator, an engine or a mechanical drive) and the controller is configured to selectively switch from the first mode to the second mode of operation whilst the rotary device continues to move in a predetermined direction associated with the first mode. Advantageously, this configuration allows switching between the first and second modes of operation with minimal impact to the motion of the rotary device or input/output device coupled thereto thereby allowing fast mode switching. Advantageously, the present embodiment allows a grid synchronised motor/generator to switch between operation as a motor and a generator without losing grid synchronisation. In one embodiment, the rotary device is configured to convert between rotary and linear motion (e.g. a crankshaft).

In one embodiment, the first and second valves are configured to selectively connect the chamber to either a high pressure region or a low pressure region. In the compression mode, the first and second valves are configured to allow gas to pass from the low pressure region to the chamber and to allow compressed gas to pass from the chamber to the high pressure region. In the expansion mode, the first and second valves are configured to allow gas to pass from the high pressure region to the chamber and to allow expanded gas to pass from the chamber to the low pressure region. In one embodiment, the first valve is configured to connect the chamber to the low pressure region and the second valve is configured to connect the chamber to the high pressure region.

In one embodiment, the apparatus is configured to allow only one of the low pressure and high pressure regions to be connected to the chamber at any one time (e.g. allow only one of the first and second valves to be open at the same time, where they are connected to the respective regions). The controller may be configured to close a connection to one region if the switching operation requires a connection to the other region to be opened. In one embodiment, by the first and second valves are configured to open automatically (i.e. without requiring activation by the controller) only when a predetermined condition occurs. For example, each of the first and second valves may be configured to open automatically only when gas pressures on either side of the valve are substantially equal. In this way, the presence of the low pressure and high pressure regions will preclude the possibility of both the first and second valves being open at the same time.

Since a valve closure signal provided by the controller to a valve is redundant if the valve is already closed, the controller may be configured to provide a valve closure signal for a further mode without changing the mode of operation. The valve closure signal for the further mode may be provided at the same point in the cycle when acting in either the compression or expansion mode and will be activated only once the valve is opened.

In one embodiment, at least one of the first and second valves is configured to open when gas pressures on either side of said at least one valve are substantially equal. For example, at least one of the first and second valves may be configured to self-open (e.g. without requiring an activation signal from the controller) when gas pressures on either side of said at least one valve are substantially equal.

In another embodiment, during the expansion mode said at least one valve is configured to prevent full venting of gas from the chamber and the positive displacement device is configured to compress gas remaining in the chamber to a pressure substantially equal to gas pressure on the other side of said at least one valve.

The positive displacement device may be configured to compress gas received in the chamber during the compression mode as the positive displacement device moves from a first configuration (e.g. first piston position) to a second configuration (e.g. second piston position) and to expand gas as the positive displacement device moves from the second configuration to the first configuration.

In a first switching operation during the compression mode, the controller is configured to allow gas to pass from the chamber to the low pressure region as the positive displacement device moves (e.g. begins to move) from the first configuration to the second configuration (i.e. to prevent compression of gas in the chamber).

In a second switching operation during the compression mode, the controller is configured to allow gas to pass from the high pressure region to the chamber as the device moves (e.g. begins to move) from the second configuration to the first configuration (i.e. to allow high pressure gas for expansion to re-enter the chamber instead of low pressure gas for compression).

In a first switching operation during the expansion mode, the controller is configured to prevent gas passing from the chamber to the low pressure region as the positive displacement device moves (e.g. begins to move) from the first configuration to the second configuration (i.e. to compress expanded gas received in the chamber).

In a second switching operation during the expansion mode, the controller is configured to prevent gas from passing from the high pressure region to the chamber as the positive displacement device moves (e.g. beings to move) from the second configuration to the first configuration.

In one embodiment, the controller is additionally configured to selectively switch operation of the positive displacement device to an unloaded mode in which energy consumption is minimised. For example, the controller may be configured to selectively switch operation of the positive displacement device to the unloaded mode during selective switching from the first mode to the second mode (i.e. with the operation of the positive displacement device changing from the first mode to the unloaded mode and from the unloaded mode to the second mode). In one embodiment, at least one of the first and second valves is held open in the unloaded mode so that gas in the chamber is neither compressed nor expanded. In another embodiment, at least one of the first and second valves is held closed to allow gas received in the chamber to be compressed and re-expanded (e.g. with little overall energy consumption occurring as a result).

In one embodiment, the present apparatus forms part of a reversible system where there is only a single positive displacement device as described above, capable of operating in both compression and expansion modes, thereby minimising the system costs and size. For example, an energy storage system may be provided that uses only one heat pump/heat engine to do both charging and discharging.

The apparatus may further comprise: a further chamber for receiving a gas; a further positive displacement device (e.g. further reciprocating piston) moveable relative to the further chamber; and third and fourth valves activatable to control flow of gas into and out of the further chamber; wherein the controller is configured to selectively switch operation of the further positive displacement device between a compression mode in which gas received in the further chamber is compressed by the further positive displacement device and an expansion mode in which gas received in the further chamber is expanded by the further positive displacement device, with selective switching from a first of the two modes to a second of the two modes being achieved by selectively changing the activation timing of at least one of the third and fourth valves during operation in the first mode.

In one embodiment, the controller is configured to switch operation of each of the first-mentioned positive displacement device and further positive displacement device from the first mode to the second mode at substantially the same time. In one embodiment, the first mode of the first-mentioned positive displacement device and the first mode of the further positive displacement device are corresponding modes (i.e. each compression modes or each expansion modes). In another embodiment, the first mode of the first-mentioned positive displacement device and the first mode of the further positive displacement device are opposite modes (i.e. one is a compression mode and one is an expansion mode so that the first-mentioned positive displacement device and further positive displacement device operate substantially out of phase).

The present invention enables an apparatus incorporating a positive displacement device operable in both a compression and an expansion mode (or multiple (e.g. pairs) of such devices each so operable) to switch from compressing a gas to expanding it merely by altering the valve activation timing, or in one embodiment, just the valve closure timing, where the valves are configured to open (preferably automatically) whenever gas pressures are roughly equal on both sides of the valve. Usually, the positive displacement device will be a linear device operatively coupled to a rotary device capable of transmitting mechanical power to an input/output device, whereby the direction of rotation (and preferably also the speed of rotation) are preserved during switching between modes. Primary applications include use in energy storage systems, and these may be either static or mobile. An example of a static system might be one using either PHES (Pumped Heat Energy Storage of the type disclosed in the applicant's earlier patent application WO 2009/044139) or CAES, where rapid switching between charging and discharging is beneficial. Where the present apparatus is operatively connected to a synchronised motor/generator that in turn is synchronised with the grid (e.g. a PHES or CAES), it is possible to switch between charge and discharge without losing synchronisation with the grid i.e. without changing direction or varying speed. An example of a mobile application would be in regenerative braking in vehicles. In this embodiment the present apparatus may be operatively connected to a vehicle drive system and, hence, the direction of rotation of the wheel is maintained, yet the system can switch seamlessly between braking (charging) and driving (i.e. discharging).

For example, the applicant's earlier patent application WO 2009/044139 for a pumped heat storage system involves a reversible system operable in a charging mode to store electrical energy as thermal energy, and operable in a discharging mode to generate electrical energy from the stored thermal energy. The system comprises two chambers each containing a positive displacement device acting as a compressor and expander, respectively, as well as a high pressure (hot) store and a lower pressure (cold) store. During the charging phase, one device compresses low pressure gas and the pressurised gas then passes through the high pressure store, where it loses its heat before being re-expanded in the other device and passing at a lower pressure through the lower pressure store where it gains heat and returns to the start of the circuit. In discharge mode, the devices are required to reverse their functions.

In grid applications, where a synchronous motor/generator is to be used it is first necessary to change the speed of rotation of the machine to a speed that allows it to be synchronised with the grid. Once synchronised, the grid frequency effectively controls the speed of rotation of the motor/generator, normally to a fixed speed of rotation. Previously, a change of mode would therefore require slowing/disconnection/reversal/speeding up/reconnection. Using the present invention, however, it is possible to switch from charging to discharging without breaking this synchronisation. The motor/generator can be switched between motoring, spinning (no load either way) and generating without a direction or speed change. For grid applications where electricity storage is being used to match sudden changes in power of a wind farm, it is important that the system can rapidly switch between different modes. In addition, synchronising can put certain mechanical stresses on the machinery if the motor/generator is synchronised when at a slightly different speed or one where the speed is correct at the time of synchronisation, but where it is increasing or decreasing. In these cases there can be significant pulse loads and hence stresses put upon components. The present invention reduces or even fully avoids these problems allowing for much improved responsivity and longevity as the system sees fewer synchronisation cycles.

In one embodiment of the present invention, at least the first valve is configured to connect the chamber to a low pressure region, at least the second valve is configured to connect the chamber to a high pressure region, and the apparatus is arranged to allow only one of the low pressure and high pressure regions to be connected to the chamber at any one time. In this arrangement, it is simplest if the valves are adapted to open automatically when the pressure either side is approximately equal (so that valve opening instructions do not need to be sent by the controller), and if valve functionality is controlled solely by the selection of the timing of valve closures.

Furthermore, the apparatus may be configured to follow a framework of fixed valve events, i.e. the valves are actuated (e.g. by deliberate activation or are automatically triggered by pressure changes) only at certain fixed positions for the piston of a reciprocating piston device. For example, a compression mode might comprise a selected framework of fixed events (e.g. C1 to C4), while an expansion mode may also comprise a selected framework of fixed events (e.g. E1 to E6). Switching between modes may be achieved by carrying out a selected subset from the framework of compression fixed events and then carrying out a selected subset from the framework of expansion fixed events, before continuing with the normal expansion framework of events. The overall effect of the switching may be that the timing of a valve closure has changed.

BRIEF DESCRIPTION OF THE DRAWINGS

Embodiments of the present invention will now be described by way of example with reference to the accompanying drawings in which:

FIG. 1 shows apparatus 10 for compressing and expanding gas, comprising first and second piston assemblies 20, 30 coupled to an input/output device 50 via a rotary crankshaft 60. Crankshaft 60 may be in turn coupled to a flywheel (not shown).

Figure 1:
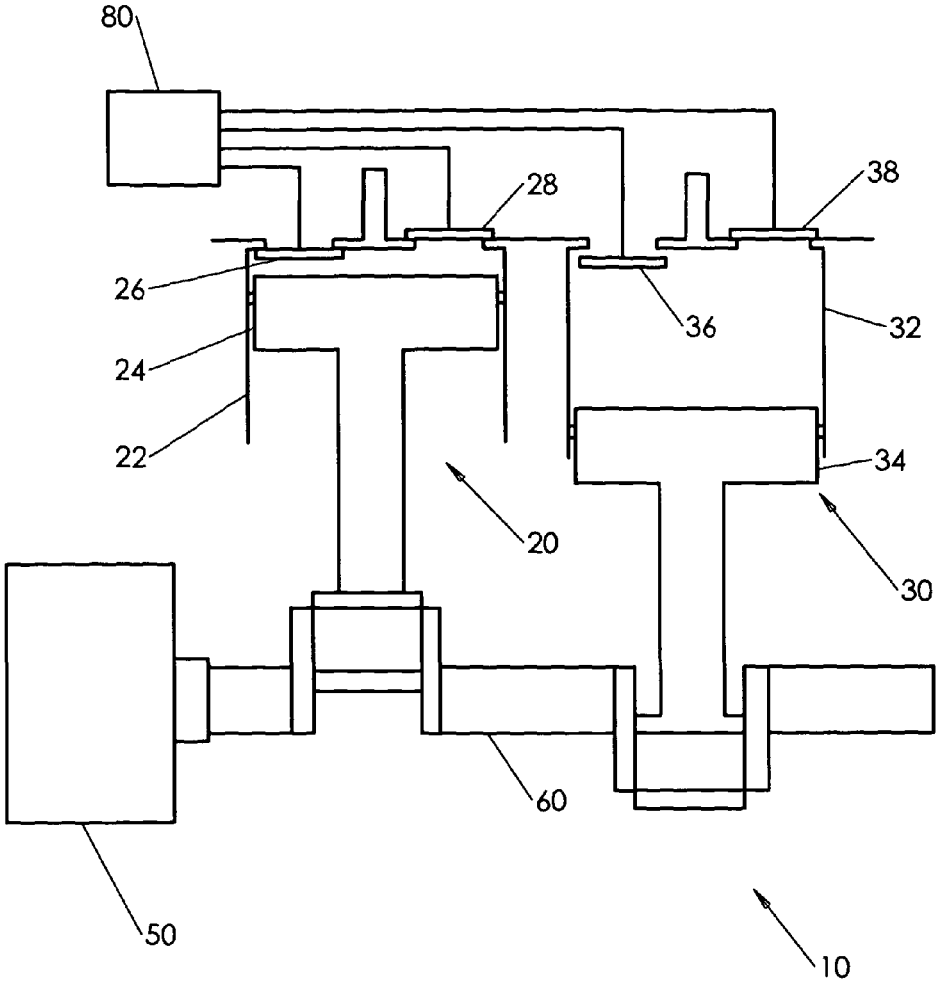
FIG. 1 shows a schematic representation of apparatus according to an embodiment of the present invention.
Figure 2A:
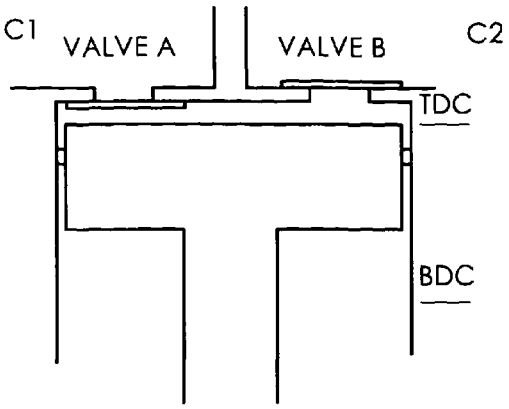
FIGS. 2A-2D illustrate valve operation in a compression mode.
Figure 2B:
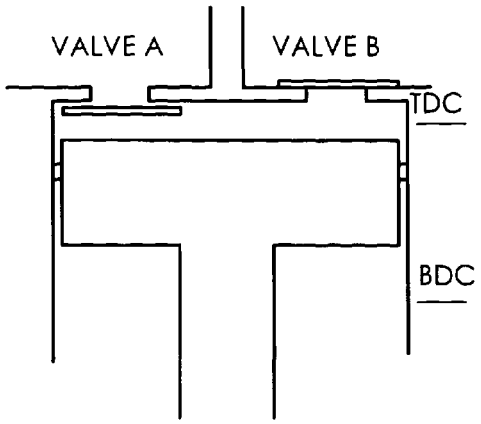
Figure 2C:
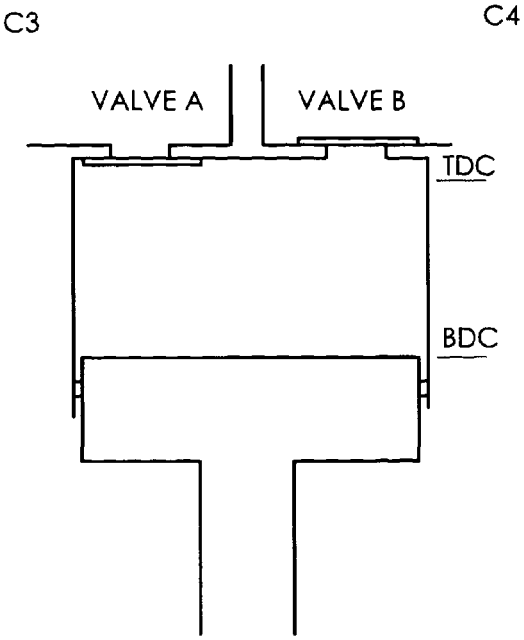
Figure 2D:
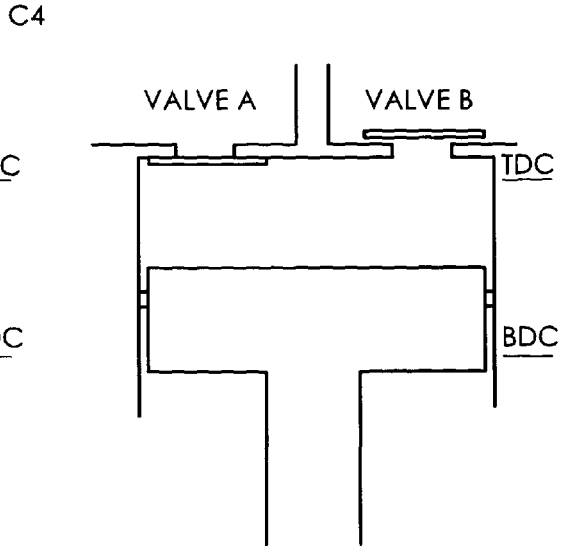
Figure 3A:
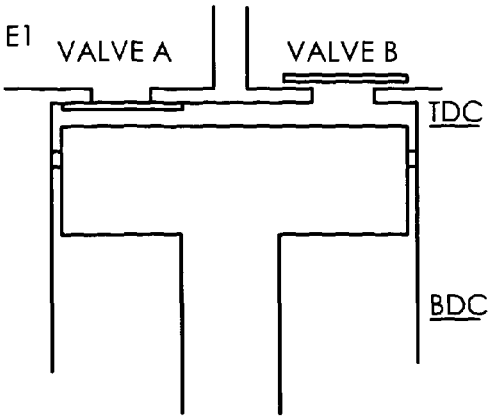
FIGS. 3A-3F illustrate valve operation in an expansion mode.
Figure 3B:
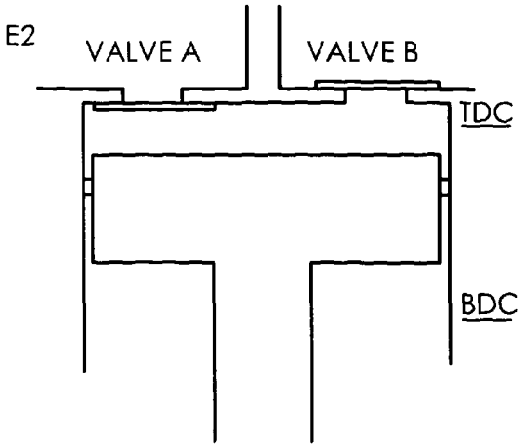
Figure 3C:
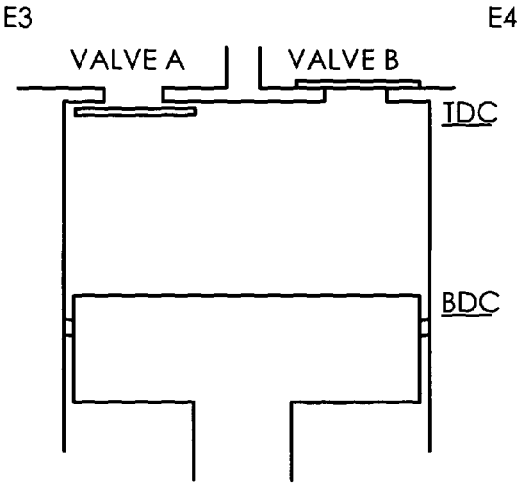
Figure 3D:
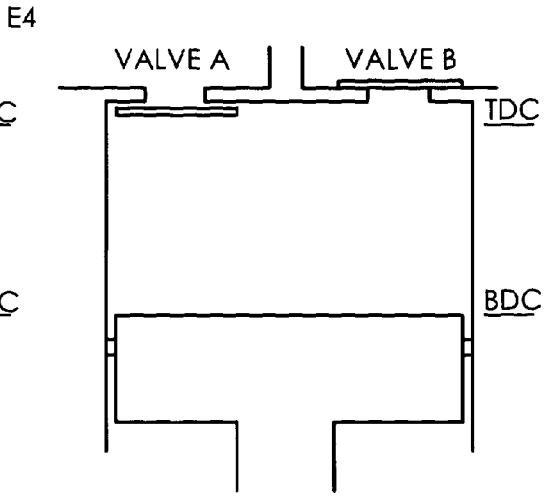
Figure 3E:
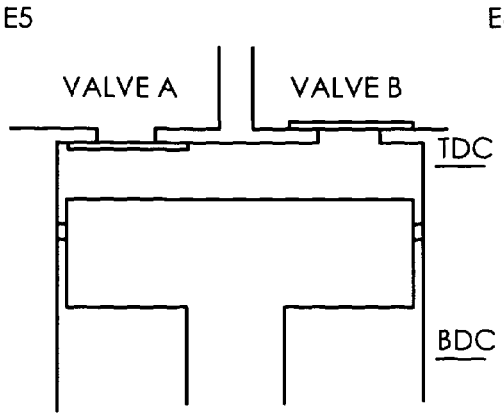
Figure 3F:
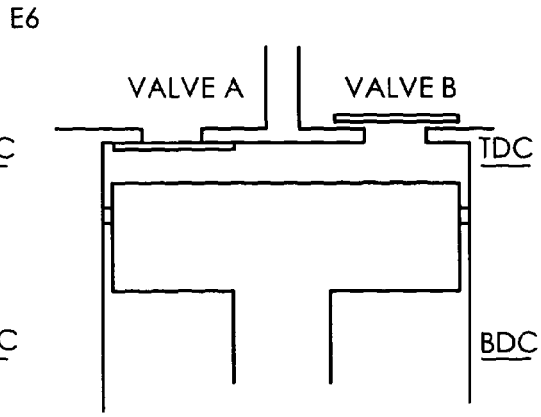

First piston assembly 20 comprises a first chamber (e.g. cylinder) 22 for receiving a gas, a first reciprocating piston 24 moveable in the first chamber 22, and first and second valves 26, 28 activatable to control flow of gas into and out of the first chamber 22. Second piston assembly 30 comprises a second chamber (e.g. cylinder) 32 for receiving a gas, a second reciprocating piston 34 moveable in the second chamber 32, and third and fourth valves 36, 38 activatable to control flow of gas into and out of the second chamber 32. The first and third valves 26, 36 are configured to selectively connect first and second chambers 22, 32 respectively to a low pressure region (e.g. ambient air source or low pressure cold store of the type used in WO 2009/044139). The second and fourth valves 28, 38 are configured to selectively connect first and second chambers 22, 32 respectively to a high pressure region (e.g. a high pressure hot store or high pressure heat exchanger).

In use, activation timing of all closure events of the first, second, third and fourth valves 26, 28, 36, 38 are controlled by a controller 80 coupled to the valves (e.g. by an electrical, mechanical, pneumatic or hydraulic connection or by any other suitable means). As discussed in more detail below, controller 80 is configured (e.g. programmed) to selectively switch operation of first piston 24 between a compression mode in which gas received in first chamber 22 is compressed by first piston 24 and an expansion mode in which gas received in first chamber 22 is expanded by first piston 24 (i.e. with expansion of gas contained in the chamber occurring as the gas does work to move the piston), with selective switching from a first of the two modes to a second of the two modes being achieved by selectively changing the activation timing of at least one of the first and second valves 26, 28 during operation in the first mode. The first and second valves 26, 28 will then reverse their function and the gas flows automatically start to reverse. Similarly, controller 80 is also configured to selectively switch operation of second piston 34 between a compression mode in which gas received in second chamber 32 is compressed by second piston 34 and an expansion mode in which gas received in second chamber 32 is expanded by second piston 34, with selective switching from a first of the two modes to a second of the two modes being achieved by selectively changing the activation timing of at least one of the third and fourth valves 36, 38 during operation in the first mode.

Each of the first, second, third and fourth valves 26, 28, 36, 38 are held closed by friction locking and are configured to open automatically only when gas pressures on either side of the valve are substantially equal. Accordingly, only one of the first and second valves 26, 28 may be open in the first piston assembly 20 at the same time. Similarly, only one of the third and fourth valves 36, 38 may be open in the second piston assembly 20 at the same time. In the case of the first piston assembly, controller 80 is configured to close one of the first and second valves 26, 28 if the switching operation requires the other valve to open. In the case of the second piston assembly, controller 80 is configured to close one of the third and fourth valves 36, 38 if the switching operation requires the other valve to open.

Operation of controller 80 is now described with reference to FIGS. 2A-2D and FIGS. 3A-3F in which valve A corresponds to first or third valves 26, 36 connected to the low pressure region and valve B corresponds to second or fourth valves 28, 38 connected to the high pressure region.

Compression Mode

With reference to FIGS. 2A-2D, the valve timing for first and second piston assemblies 20, 30 in the compression mode are set out below, where: TDC=top dead centre; BDC=bottom dead centre.

| | | Compressor Mode | A (INLET) | B (OUTLET) |
|---|---|---|---|---|
| START | C1 | TDC | CLOSED | CLOSES |
| | C2 | Just after TDC on way down at or near pressure equalisation with low pressure side | OPENS | CLOSED |
| | C3 | BDC | CLOSES | CLOSED |
| | C4 | Partway through upstroke at or near pressure equalisation with high pressure side | CLOSED | OPENS |
| REPEATS | C1 | TDC | CLOSED | CLOSES |

Expansion Mode

With reference to FIGS. 3A-3F, the valve timing for first and second piston assemblies 20, 30 in the expansion mode is as follows:

| | | Expander Mode | A (OUTLET) | B (INLET) |
|---|---|---|---|---|
| START | E1 | TDC | CLOSED | OPEN |
| | E2 | After TDC on way down | CLOSED | CLOSES |
| | E3 | Prior to BDC at or near pressure equalisation with low pressure side | OPENS | CLOSED |
| | E4 | BDC | OPEN | CLOSED |
| | E5 | Before TDC and allowing for enough space to recompress remaining gas to high pressure | CLOSES | CLOSED |
| | E6 | Just before TDC and at or near pressure equalisation with high pressure side | CLOSED | OPENS |
| REPEATS | E1 | TDC | CLOSED | OPEN |

Change from Compression Mode to Expansion Mode

Controller 80 is configured in this embodiment to switch operation of first and second piston assemblies 20, 30 from the compression mode to the expansion mode by changing valve closure timing after either valve A or valve B have closed. The change of timing for two different switching modes is listed below:

| | | Switching from Compressor to Expander 1 | A | B |
|---|---|---|---|---|
| START | C1 | TDC | CLOSED | CLOSES |
| | C2 | Just after TDC on way down at or near pressure equalisation with low pressure side | OPENS | CLOSED |
| SWITCH | E4 | BDC | OPEN | CLOSED |
| | E5 | Before TDC and allowing for enough space to recompress remaining gas to high pressure | CLOSES | CLOSED |
| | E6 | Just before TDC and at or near pressure equalisation with high pressure side | CLOSED | OPENS |
| | E1 | TDC | CLOSED | OPEN |
| | E2 | After TDC on way down | CLOSED | CLOSES |
| | E3 | Prior to BDC at or near pressure equalisation with low pressure side | OPENS | CLOSED |
| REPEATS | E4 | BDC | OPEN | CLOSED |
| | | Valve B Closes as Normal then switch Valve A Closure changes from BDC to just before TDC on way up | | |

-continued

| | | Valve B Closure changes from TDC to after TDC on way down | | |
|---|---|---|---|---|
| | | Switching from Compressor to Expander 2 | A | B |
| START | C3 | BDC | CLOSES | CLOSED |
| | C4 | Partway through upstroke at or near pressure equalisation with high pressure side | CLOSED | OPENS |
| SWITCH | E1 | TDC | CLOSED | OPEN |
| | E2 | After TDC on way down | CLOSED | CLOSES |
| | E3 | Prior to BDC at or near pressure equalisation with low pressure side | OPENS | CLOSED |
| | E4 | BDC | OPEN | CLOSED |
| | E5 | Before TDC and allowing for enough space to recompress remaining gas to high pressure | CLOSES | CLOSED |
| | E6 | Just before TDC and at or near pressure equalisation with high pressure side | CLOSED | OPENS |
| REPEATS | E1 | TDC | CLOSED | OPEN |
| | | Valve A Closes as Normal then switch Valve B Closure changes from TDC to after TDC on way down | | |
| | | Valve A Closure changes from BDC to just before TDC on way up | | |

Change from Expansion Mode to Compression Mode

Controller 80 is further configured in this embodiment to switch operation of first and second piston assemblies 20, 30 from the expansion mode to the compression mode by changing valve closure timing after either valve A or valve B have closed. The change of timing for two different switching modes is listed below:

| | | Switching from Expander to Compressor 1 | A (OUTLET) | B (INLET) |
|---|---|---|---|---|
| START | E1 | TDC | CLOSED | OPEN |
| | E2 | After TDC on way down | CLOSED | CLOSES |
| | E3 | Prior to BDC at or near pressure equalisation with low pressure side | OPENS | CLOSED |
| SWITCH | C3 | BDC | CLOSES | CLOSED |
| | C4 | Partway through upstroke at or near pressure equalisation with high pressure side | CLOSED | OPENS |
| | C1 | TDC | CLOSED | CLOSES |
| | C2 | Just after TDC on way down at or near pressure equalisation with low pressure side | OPENS | CLOSED |
| REPEATS | C3 | BDC | CLOSES | CLOSED |
| | | Valve B Closes as Normal then switch Valve A Closure changes from just before TDC on way up to BDC | | |
| | | Valve B from after TDC on way down to TDC | | |

| | | Switching from Expander to Compressor 2 | A (OUTLET) | B (INLET) |
|---|---|---|---|---|
| START | E4 | BDC | OPEN | CLOSED |
| | E5 | Before TDC and allowing for enough space to recompress remaining gas to high pressure | CLOSES | CLOSED |
| | E6 | Just before TDC and at or near pressure equalisation with high pressure side | CLOSED | OPENS |
| SWITCH | C1 | TDC | CLOSED | CLOSES |
| | C2 | Just after TDC on way down at or near pressure equalisation | OPENS | CLOSED |

-continued

| | | | | |
|---|---|---|---|---|
| | | with low pressure side | | |
| | C3 | BDC | CLOSES | CLOSED |
| | C4 | Partway through upstroke at or near pressure equalisation with high pressure side | CLOSED | OPENS |
| REPEATS | C1 | TDC<br>Valve A Closes as Normal then switch Valve B from after TDC on way down to TDC<br>Valve A Closure changes from just before TDC on way up to BDC | CLOSED | CLOSES |

In all four switching modes identified above, the change to the valve actuation timing is configured to occur whilst crankshaft 60 continues to rotate in a predetermined direction (i.e. clockwise or anticlockwise) associated with the first mode. Advantageously, this configuration allows switching between the first and second modes of operation with minimal impact to the motion of crankshaft 60 and input/output device 50 thereby allowing fast mode switching.

In all switching modes, if a valve is already closed and a closing actuator is fired this has no effect on the valve which remains closed. This means that a defined positional closing event can be nullified if the valve is placed in a closed configuration prior to this event. Accordingly, controller 80 may be configured to provide a valve closure signal at the same point in the cycle when acting in either the compression or expansion mode.

Input/output device 50 may for example be a grid synchronised motor/generator and the apparatus may be configured to run as a compressor to store energy as compressed air and as an expander to recover the energy as electricity. In another example, input/output device 50 may be a vehicle motor and the apparatus may be configured to run as a compressor to store energy as compressed air (e.g. during braking) and as an expander to recover the energy (e.g. to give a power boost).

In a further mode, each of the first and second piston assemblies 20, 30 may be unloaded by ensuring that either at least one valve is either kept closed (e.g. so that gas in one of the chambers 22, 32 is compressed and re-expanded) or held open (e.g. so that no compression of gas in chambers 22, 32 can occur). In this way, apparatus 10 may be configured to operate in a minimum energy consumption pattern.

Although the present embodiment illustrated two piston assemblies, the apparatus may comprise at least one further piston assembly. In one mode of operation, controller 80 may be configured to operate a fixed proportion of the piston assemblies (e.g. half) in the compression mode and a fixed proportion of the piston assemblies (e.g. half) in the expansion mode. In another mode of operation, controller 80 may be configured to operate all piston assemblies in the compression mode or all of the piston assemblies in the expansion mode. In yet another mode, controller 80 may be configured to have varying proportions of compressor and expanders. In yet another mode, controller 80 may be configured to operate at least one of the piston assemblies in the unloaded mode described above so that the piston assemblies may be configured to act as compressors, expanders, unloaded or a combination of all three. Advantageously, the piston assemblies may change modes of operation between expander, compressor and unloaded as required without crankshaft 60 changing direction of rotation.

In one compression mode, controller 80 may be configured to partially unload a piston assembly ensuring the inlet valve is fired shut late (i.e. on the up stroke or the outlet valve is fired shut early, i.e. after TDC during the down stroke). In this way the overall capacity of gas compressed is reduced and the apparatus can operate in a part loaded manner.

In one expansion mode, controller 80 may be configured to partially unload a piston assembly by ensuring that the inlet valve is fired shut earlier on the down stroke (i.e. nearer TDC) or the outlet valve is fired shut early i.e. before TDC. In this way the overall capacity of gas expanded is reduced and the machine can operate in a part loaded manner.

Figure 4A:
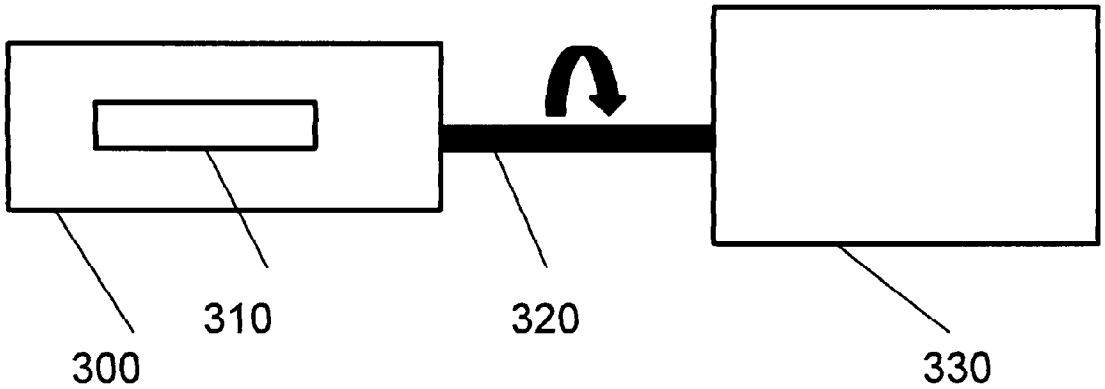
FIGS. 4*a* and 4*b* are schematic illustrations of mobile and static energy storage systems respectively comprising the apparatus according to the present invention.
Figure 4B:
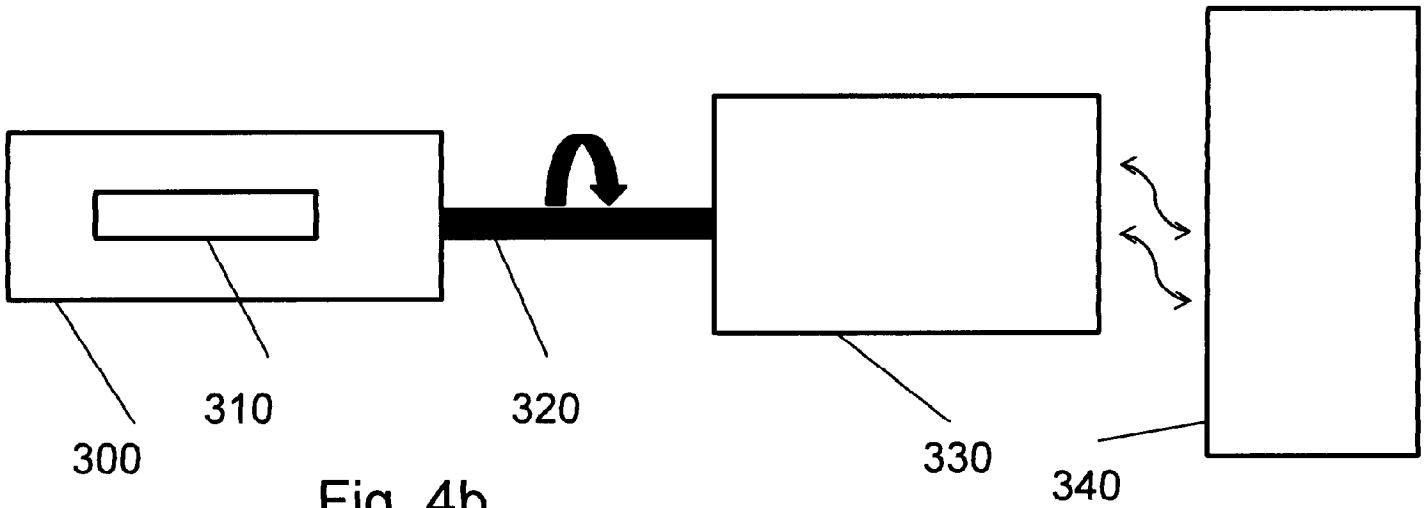

FIG. 4*a* is a schematic illustration of an energy storage system in which apparatus 300 according to the present invention includes a positive displacement device 310 preferably a linear device (e.g. reciprocating piston), operatively coupled via rotary device 320 for power transmission to an input/output device 330, whereby the direction of rotation (and in one embodiment advantageously also the speed of rotation) are preserved during switching between modes. The system may be used in a mobile application (e.g. a regenerative braking system in a vehicle), or, as shown in FIG. 4*b*, a similar system may be employed in a static application where the input/output device 330 is optionally synchronised to the national grid 340.

Figure 5:
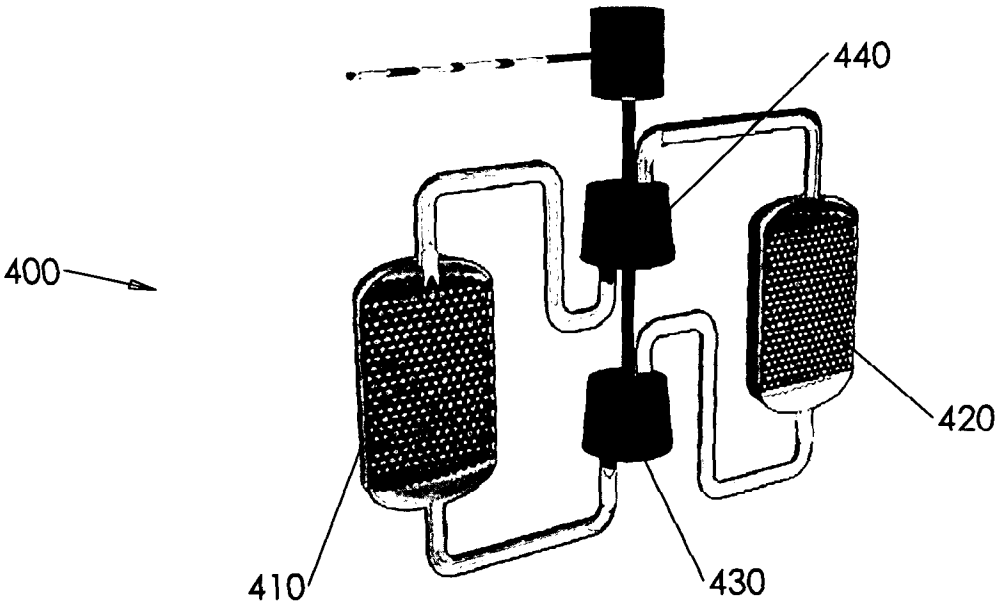
FIG. 5 is a schematic illustration of a pumped heat storage system comprising the apparatus according to the present invention.

FIG. 5 is a schematic illustration of one example of a pumped heat storage system 400 comprising apparatus 430, 440 according to the present invention, a first heat storage vessel 410 for receiving and storing thermal energy from compressed gas (forming a high pressure hot store) and a second heat storage vessel 420 for transferring thermal energy to expanded gas (forming a low pressure cold store). The pumped heat storage system 400 is operable in a charging mode to store electrical energy as thermal energy, and operable in a discharging mode to generate electrical energy from the stored thermal energy, and the system comprises at least two respective chambers 430, 440 each containing the positive displacement devices according to the invention, these being respectively configured to act in a compression mode and expansion mode during the charging mode and vice versa in the discharging mode, whereby the switching of the devices is achieved according to the invention. This particular arrangement of using a hot and cold store in a heat storage system corresponds to the system described above in relation to the applicant's earlier application WO2009/044139. In that prior art system, the two displacement devices can be split into separate devices or can be combined into a single device acting as a heat pump/heat engine.

The invention claimed is:

1. A method of gas compression and expansion, the method comprising:

receiving a gas in a chamber for which first and second valves are operable to control gas flow into and out of the chamber; and selectively changing, with a controller, an activation timing of at least one of the first and second valves to selectively switch operation of a positive displacement device moveable relative to the chamber between a compression mode in which the gas received in the chamber is compressed by the positive displacement device and an expansion mode in which the gas received in the chamber is expanded by the positive displacement device, wherein the activation timing is changed during the operation of the positive displacement device in one of the compression and expansion modes.

2. The method according to claim 1, further comprising:

transmitting, via the positive displacement device being coupled to a rotary device, mechanical power between the positive displacement device and an input/output device; and selectively switching, via the controller, from one of the compression and expansion modes to the other of the compression and expansion modes of operation whilst the rotary device continues to move in a predetermined direction associated with the one of the compression and expansion modes.

3. The method according to claim 2, further comprising switching of a grid synchronised motor/generator of the input/output device between operation as a motor and a generator during a switch between the compression and expansion modes, without losing grid synchronisation.

4. The method according to claim 1, further comprising selectively connecting, via the first and second valves, the chamber to either a high pressure region or a low pressure region.

5. The method according to claim 4, further comprising allowing only one of the low pressure and high pressure regions to be connected to the chamber at any one time.

6. The method according to claim 1, further comprising:

opening at least one of the first and second valves when gas pressures on either side of said at least one valve are equal; and altering, via the controller, a valve closure timing of said at least one valve to selectively switch from the one of the compression and expansion modes to the other of the compression and expansion modes.

7. The method according to claim 6, further comprising self-opening of at least one of the first and second valves when gas pressures on either side of said at least one valve are equal.

8. The method according to claim 1, further comprising reversing, upon switching between the compression and expansion modes, functions of the first and second valves such that the gas flows in a reversed direction.

* * * * *